US010738607B2

(12) United States Patent
Proett et al.

(10) Patent No.: US 10,738,607 B2
(45) Date of Patent: Aug. 11, 2020

(54) DOWNHOLE FORMATION TESTING AND SAMPLING APPARATUS HAVING A DEPLOYMENT LINKAGE ASSEMBLY

(71) Applicant: Halliburton Energy Services, Inc., Houston, TX (US)

(72) Inventors: Mark A. Proett, Missouri City, TX (US); Clovis S. Bonavides, Houston, TX (US)

(73) Assignee: HALLIBURTON ENERGY SERVICES, INC., Houston, TX (US)

( * ) Notice: Subject to any disclaimer, the term of this patent is extended or adjusted under 35 U.S.C. 154(b) by 466 days.

(21) Appl. No.: 14/767,555

(22) PCT Filed: Mar. 15, 2013

(86) PCT No.: PCT/US2013/032596

§ 371 (c)(1),
(2) Date: Aug. 12, 2015

(87) PCT Pub. No.: WO2014/143052

PCT Pub. Date: Sep. 18, 2014

(65) Prior Publication Data

US 2016/0053612 A1 Feb. 25, 2016

(51) Int. Cl.

| | |
|---|---|
| ***E21B 49/10*** | (2006.01) |
| ***E21B 17/10*** | (2006.01) |
| ***E21B 49/08*** | (2006.01) |

(52) U.S. Cl.
CPC ..... *E21B 49/10* (2013.01); *E21B 17/1021* (2013.01); *E21B 49/088* (2013.01)

(58) Field of Classification Search
CPC ..... E21B 17/1021; E21B 49/088; E21B 49/10
See application file for complete search history.

(56) References Cited

U.S. PATENT DOCUMENTS 3,396,796 A * 8/1968 Voetter ..... E21B 49/10 166/100
3,577,781 A 5/1971 Lebourg et al.
(Continued)

OTHER PUBLICATIONS

Al-Otaibi et al., Oil-Water Delineation with a New Formation Tester Module, Society of Petroleum Engineers Annual Technical Conference and Exhibition, Oct. 8-10, 2012, SPE 159641.
(Continued)

*Primary Examiner* — Robert E Fuller
*Assistant Examiner* — Lamia Quaim
(74) *Attorney, Agent, or Firm* — Haynes and Boone, LLP

(57) ABSTRACT

A downhole formation testing and sampling apparatus. The apparatus includes a setting assembly and an actuation module that is operable to apply an axial compressive force to the setting assembly shifting the setting assembly from a radially contracted running configuration to a radially expanded deployed configuration. A plurality of probes is coupled to the setting assembly. Each probe has a sealing pad with an outer surface operable to seal a region along a surface of the formation to establish the hydraulic connection therewith when the setting assembly is operated from the running configuration to the deployed configuration. Each sealing pad has at least one opening establishing fluid communication between the formation and the interior of the apparatus. In addition, each sealing pad has at least one recess operable to establish fluid flow from the formation to the at least one opening.

25 Claims, 9 Drawing Sheets

(56) References Cited

U.S. PATENT DOCUMENTS

| | | | | |
|---|---|---|---|---|
| 3,677,080 | A | 7/1972 | Hallmark | |
| 3,677,081 | A * | 7/1972 | Newton | E21B 49/10 166/100 |
| 5,864,057 | A | 1/1999 | Baird | |
| 8,015,867 | B2 | 9/2011 | Kerr et al. | |
| 8,028,756 | B2 * | 10/2011 | Corre | B29C 35/0227 166/187 |
| 8,235,106 | B2 | 8/2012 | Fox et al. | |
| 2004/0173351 | A1 * | 9/2004 | Fox | E21B 49/10 166/264 |
| 2008/0135240 | A1 * | 6/2008 | Brennan | E21B 33/1216 166/264 |
| 2009/0211752 | A1 | 8/2009 | Goodwin et al. | |
| 2010/0018704 | A1 | 1/2010 | Zazovsky et al. | |
| 2010/0132940 | A1 | 6/2010 | Proett et al. | |
| 2011/0067860 | A1 | 3/2011 | Corre et al. | |
| 2012/0111632 | A1 | 5/2012 | Sherrill et al. | |
| 2012/0131996 | A1 * | 5/2012 | Anish | E21B 17/1021 73/152.54 |
| 2012/0292024 | A1 * | 11/2012 | Fox | E21B 49/10 166/264 |

OTHER PUBLICATIONS

Flores de Dios, New Wireline Formation Tester Development Makes Sampling and Pressure Testing Possible in Extra-Heavy Oils in Mexico, Society of Petroleum Engineers Annual Technical Conference and Exhibition, Oct. 8-10, 2012, SPE 159868.

International Search Report and the Written Opinion of the International Searching Authority, or the Declaration, dated Dec. 17, 2013, PCT/US2013/032596, 13 pages, ISA/KR.

Extended European Search Report for EP 13878297, 6 pages, dated Jul. 28, 2016.

* cited by examiner

DOWNHOLE FORMATION TESTING AND SAMPLING APPARATUS HAVING A DEPLOYMENT LINKAGE ASSEMBLY

The present application is a U.S. National Stage patent application of International Patent Application No. PCT/US2013/032596, filed on Mar. 15, 2013, the benefit of which is claimed and the disclosure of which is incorporated herein by reference in its entirety.

TECHNICAL FIELD OF THE PRESENT DISCLOSURE

This disclosure relates, in general, to equipment utilized in conjunction with operations performed in relation to hydrocarbon bearing subterranean wells and, in particular, to a downhole formation testing and sampling apparatus and a method for testing and sampling formation fluid.

BACKGROUND

Without limiting the scope of the present disclosure, its background will be described with reference to evaluation of hydrocarbon bearing subterranean formations, as an example.

It is well known in the subterranean well drilling and completion art to perform tests on formations intersected by a wellbore. Such tests are typically performed in order to determine geological or other physical properties of the formation and fluids contained therein. For example, parameters such as permeability, pore pressure, porosity, fluid resistivity, directional uniformity, temperature, pressure, bubble point and fluid composition may be determined. These and other characteristics of the formation and fluid contained therein may be determined by performing tests on the formation before the well is completed.

One type of tool used for testing formations includes an elongated tubular body divided into several modules serving predetermined functions. For example, the testing tool may have a hydraulic power module that converts electrical into hydraulic power, a telemetry module that provides electrical and data communication between the modules and an uphole control unit, one or more probe modules that collect samples of the formation fluids, a flow control module that regulates the flow of formation and other fluids in and out of the tool and a sample collection module that may contain one or more chambers for storage of the collected fluid samples.

The probe modules may have one or more probe-type devices that create a hydraulic connection with the formation in order to measure pressure and take formation samples. Typically, these devices use a toroidal rubber cup-seal, which is pressed against the side of the wellbore while a probe is extended from the tester in order to extract wellbore fluid and affect a drawdown. The rubber seal of the probe is typically about 3-5 inches in diameter, while the probe itself is only about half an inch to an inch in diameter. It has been found, however, that due to the small area contacted by such probes, a hydrocarbon deposit or other valuable information may be missed.

Attempts have been made to overcome the above sampling limitations using, for example, straddle packers in association with a downhole formation testing tool. The straddle packers are inflatable devices typically mounted on the outer periphery of the tool and can be placed as far as several meters apart from each other. When expanded, the packers isolate a section of the wellbore and samples of the formation fluid from the isolated area can be drawn through one or more inlets located between the packers. Although the use of straddle packers may significantly improve the flow rate over the conventional probe-type devices described above, the straddle packer type testing tools also have several important limitations. For example, the volume of fluid between the straddle packers results in long clean up time and, even after clean up, the samples are not obtained directly from the formation.

Therefore, a need has arisen for an improved downhole formation testing and sampling apparatus that is operable to provide an accurate estimate of a reservoir's producibility. A need has also arisen for such an improved downhole formation testing and sampling apparatus that is operable to provide a large exposure volume without requiring a long clean up time. Further, a need has arisen for such an improved downhole formation testing and sampling apparatus that is operable to obtain fluid samples directly from the formation.

BRIEF DESCRIPTION OF THE DRAWINGS

For a more complete understanding of the present disclosure, reference is now made to the detailed description of the various embodiments along with the accompanying figures in which corresponding numerals in the different figures refer to corresponding parts and in which.

DETAILED DESCRIPTION

Figure 1:
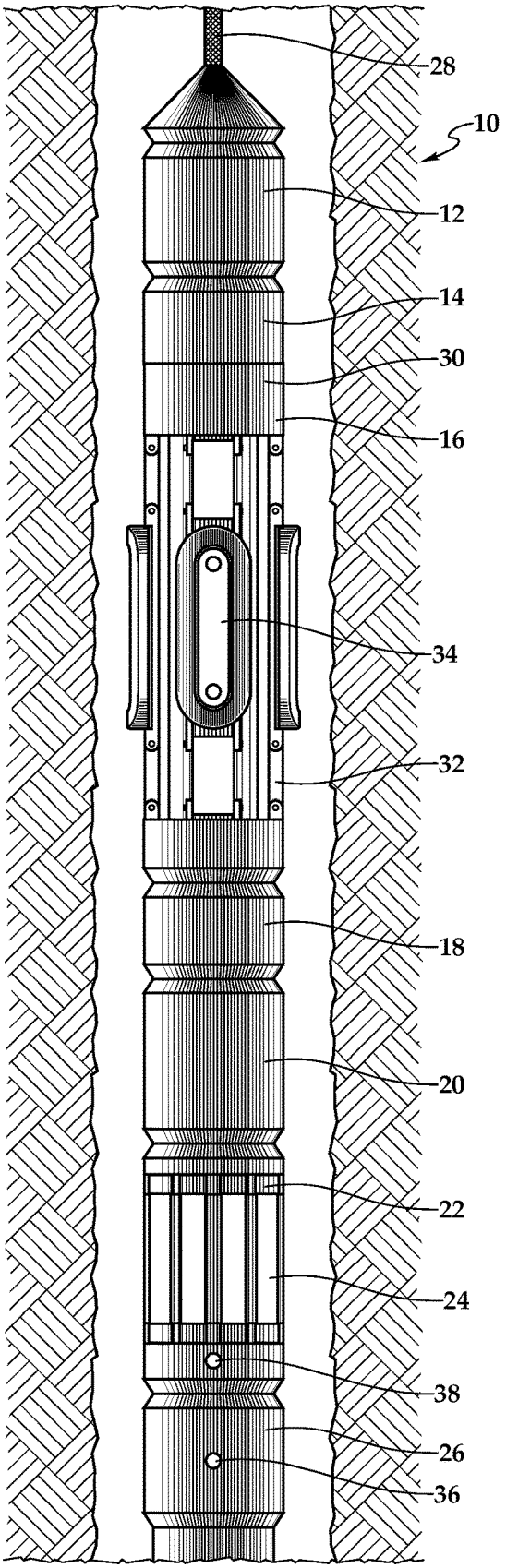
FIG. 1 is a schematic illustration of a well system including a downhole formation testing and sampling apparatus in its running configuration.

While various system, method and other embodiments are discussed in detail below, it should be appreciated that the present disclosure provides many applicable inventive concepts, which can be embodied in a wide variety of specific contexts. The specific embodiments discussed herein are merely illustrative, and do not delimit the scope of the present disclosure.

The present disclosure is directed to an improved downhole formation testing and sampling apparatus that is operable to provide an accurate estimate of a reservoir's producibility. The improved downhole formation testing and sampling apparatus of the present disclosure is operable to provide a large exposure volume without requiring a long clean up time. In addition, the improved downhole formation testing and sampling apparatus of the present disclosure is operable to obtain fluid samples directly from the formation.

In one aspect, the present disclosure is directed to a downhole formation testing and sampling apparatus. The apparatus includes a setting assembly having a radially contracted running configuration and a radially expanded deployed configuration. An actuation module is operably associated with the setting assembly and is operable to apply an axial compressive force to the setting assembly to shift the setting assembly from the running configuration to the deployed configuration. At least one probe is coupled to the setting assembly. The probe has a sealing pad with an outer surface operable to seal a region along a surface of the formation to establish a hydraulic connection therewith when the setting assembly is operated from the running configuration to the deployed configuration. The sealing pad has at least one opening establishing fluid communication between the formation and the interior of the apparatus. In addition, the sealing pad has at least one recess operable to establish fluid flow from the formation to the at least one opening.

In some embodiments, the apparatus may include a fluid collection chamber for storing samples of retrieved fluids. In other embodiments, the apparatus may include a sensor for determining a property of the collected fluid. In one embodiment, the setting assembly may include a setting mandrel and a linkage assembly. In this embodiment, the at least one probe is coupled to the linkage assembly such that axial shifting of the setting mandrel responsive to the axial compressive force causes radial deployment of the linkage assembly and the probe. Also, in this embodiment, the linkage assembly may have at least two rotating arms. In one embodiment, the sealing pad may be formed from an elastomeric material. In this embodiment, the elastomeric material of the sealing pad may be reinforced with a steel aperture near the at least one opening of the sealing pad. In certain embodiments, the sealing pad may include a filter medium. In some embodiments, the region of the formation surface sealed by the sealing pad may be elongated and oriented along a longitudinal axis of a borehole.

In another aspect, the present disclosure is directed to a downhole formation testing and sampling apparatus. The apparatus includes a setting assembly having a radially contracted running configuration and a radially expanded deployed configuration. An actuation module is operably associated with the setting assembly and is operable to apply an axial compressive force to the setting assembly to shift the setting assembly from the running configuration to the deployed configuration. A plurality of probes is coupled to the setting assembly. The probes each have a sealing pad with an outer surface operable to seal a region along a surface of the formation to establish a hydraulic connection therewith when the setting assembly is operated from the running configuration to the deployed configuration. Each of the sealing pads has at least one opening establishing fluid communication between the formation and the interior of the apparatus. In addition, each of the sealing pads has at least one recess operable to establish fluid flow from the formation to the at least one opening.

In one embodiment, the probes are circumferentially distributed about the setting assembly. In another embodiment, the probes are uniformly circumferentially distributed about the setting assembly. In still other embodiments, the probes are longitudinally distributed about the setting assembly. In further embodiments, the probes are circumferentially and longitudinally distributed about the setting assembly. In one embodiment, the setting assembly may include a setting mandrel and a linkage assembly. In this embodiment, the probes are coupled to the linkage assembly such that axial shifting of the setting mandrel responsive to the axial compressive force causes radial deployment of the linkage assembly and the probes. Also, in this embodiment, the setting mandrel may include a plurality of independent mandrel sections each operable to radial deploy a portion of the linkage assembly and a portion of the probes.

In a further aspect, the present disclosure is directed to a method of testing and sampling formation fluid. The method includes running a formation testing and sampling apparatus into a borehole, the apparatus having a setting assembly, an actuation module operably associated with the setting assembly and at least one probe coupled to the setting assembly, the probe having a sealing pad with an outer surface operable to seal a region along a surface of the formation to establish a hydraulic connection therewith, the sealing pad having at least one opening in fluid communication with the interior of the apparatus, the sealing pad having at least one recess operable to establish fluid flow from the formation to the at least one opening. The method also includes actuating the actuation module to apply an axial compressive force to the setting assembly; shifting the setting assembly from a radially contracted running configuration to a radially expanded deployed configuration; establishing the hydraulic connection between the sealing pad and the formation; and drawing fluid from the region of the formation into the apparatus. The method may also include axial shifting a setting mandrel; radially deploying a linkage assembly and/or rotating at least two rotating arms.

Figure 2:
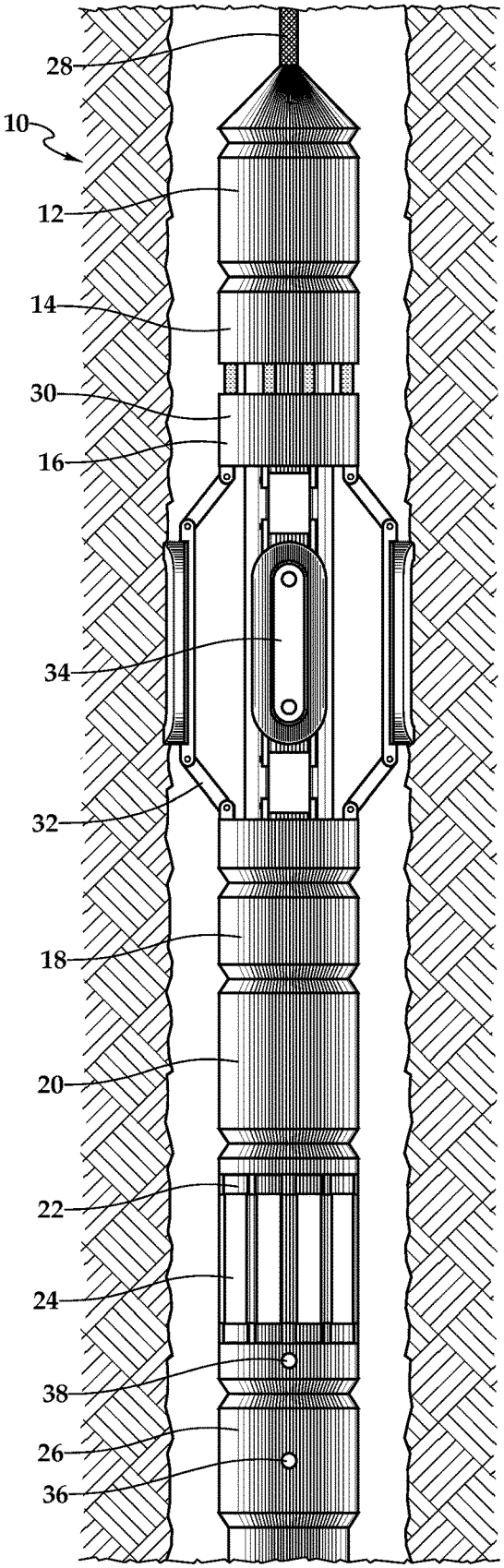
FIG. 2 is a schematic illustration of a well system including a downhole formation testing and sampling apparatus in its deployed configuration.

Referring initially to FIGS. 1 and 2, therein are depicted schematic illustrations of a well system including a downhole formation testing and sampling apparatus 10 in its radially contracted running configuration and its radially expanded deployed configuration, respectively. Formation testing and sampling apparatus or tool 10 includes a plurality of modules or sections capable of performing various functions. In the illustrated embodiment, tool 10 include a power telemetry module 12 that provides electrical and data communication between the modules of tool 10 and a remote control unit (not pictured) that may be located uphole or at the surface, an actuation module 14 that converts electrical power into hydraulic power, a probe module 16 that takes samples of the formation fluids, a fluid test module 18 that performs various tests on fluid samples, a flow control module 20 that regulates the flow of fluids in and out of tool 10, a multi-chamber sample collection module 22 that includes a plurality of chambers 24 for storage of the collected fluid samples and possibly other sections designated collectively as module 26. Even though a particular arrangement of the various modules has been described and depicted in FIG. 1, those skilled in the art will understand that other arrangements of modules including both a greater number and a lesser number of modules is possible and is considered to be within the scope of the present disclosure.

More specifically, power telemetry section 12 conditions power for the remaining tool sections. Each section preferably has its own process-control system and can function independently. While section 12 provides a common intra-tool power bus, the entire tool string shares a common communication bus that is compatible with other logging tools. Tool 10 is conveyed in the borehole by wireline 28, which contains conductors for carrying power to the various components of tool 10 and conductors or cables such as coaxial or fiber optic cables for providing two-way data communication between tool 10 and the remote control unit. The control unit preferably comprises a computer and associated memory for storing programs and data. The control unit generally controls the operation of tool 10 and processes data received from it during operations. The control unit may have a variety of associated peripherals, such as a recorder for recording data, a display for displaying desired information, printers and the like. The use of the control unit, display and recorder are known in the art of well logging and are, thus, not discussed further. In a specific embodiment, telemetry module 12 may provide both electrical and data communication between the modules and the control unit. In particular, telemetry module 12 provides a high-speed data bus from the control unit to the modules to download sensor readings and upload control instructions initiating or ending various test cycles and adjusting different parameters, such as the rates at which various pumps are operating. Even though tool 10 has been depicted as being wireline conveyed, it should be understood by those skilled in the art that tool 10 could alternatively be conveyed by other means including, but not limited to, coiled tubing or jointed tubing such as drill pipe. It should also be noted that tool 10 could be part of a logging while drilling (LWD) tool string wherein power for the tool systems may be generated by a turbine driven by circulating mud and data may be transmitted using a mud pulse module.

Actuation module 14 is operably associated with a setting assembly 30 including a linkage assembly 32 of probe module 16. Actuation module 14 is operated to apply an axial compression force on setting assembly 30. In the illustrated embodiment, when the axial compression force is applied to linkage assembly 32 of setting assembly 30, linkage assembly 32 is operated from its radially contracted running configuration (FIG. 1) to its radially expanded deployed configuration (FIG. 2), which radially outwardly deploys probes 34 to establish a hydraulic connection between probes 34 and the formation. In the illustrated embodiment, actuation module 14 is depicted as an electro-hydraulic module including an electric motor operable to supply pressurized fluid that acts on one or more hydraulic cylinders that apply the axial compression force on setting assembly 30. Even though actuation module 14 has been described and depicted as being an electrohydraulic module, it should be understood by those skilled in the art that actuation module 14 could alternatively apply the axial compression force on setting assembly 30 by other means including, but not limited to, electromechanical means such as using a direct drive electrical motor with a screw mechanism that is operated to apply the axial compression force on setting assembly 30.

Fluid testing section 18 of tool 10 contains one or more fluid testing devices (not visible in FIG. 1), which analyze the fluid samples obtained during sampling operations. For example, one or more fluid sensors may be utilized to analyze the fluid such as quartz gauges that enable measurement of such parameters as the drawdown pressure of fluid being withdrawn and fluid temperature. In addition, if at least two fluid testing devices are run in tandem, the pressure difference between them can be used to determine fluid viscosity during pumping or fluid density when flow is stopped. Also, when flow is stopped, a pressure buildup analysis can be preformed.

Flow control module 20 of tool 10 includes a pump such as a double acting piston pump (not visible in FIG. 1), which controls the formation fluid flow into tool 10 from probes 34. The pump's operation is generally monitored by the control unit. Fluid entering probes 34 flows through one or more flow lines (not visible in FIG. 1) and may be discharged into the wellbore via outlet 36. Fluid control devices, such as control valves and/or a manifold (not visible in FIG. 1), may be connected to the flow lines for controlling the fluid flow from the flow lines into the borehole or into storage chambers 24. Flow control module 18 may further include strain-gauge pressure transducers that measure inlet and outlet pump pressures.

Sample collection module 22 of tool 10 may contain various size chambers 24 for storage of the collected fluid samples. Chamber section 22 preferably contains at least one collection chamber 24, preferably having a piston that divides chamber 24 into a top chamber and a bottom chamber. A conduit may be coupled to the bottom chamber to provide fluid communication between the bottom chamber and the outside environment such as the wellbore via one or more fluid ports 38. A fluid flow control device, such as an electrically controlled valve, can be placed in the conduit to selectively open it to allow fluid communication between the bottom chamber and the wellbore. Similarly, chamber section 24 may also contain a fluid flow control device, such as an electrically operated control valve, which is selectively opened and closed to direct the formation fluid from the flow lines into the upper chamber. Preferably, one or more sensors are used to determine when the formation fluid is clean then the control valve is opened to allow a sample to be taken. As a sample is taken in the upper side of chamber 24, the piston may be driven down to the bottom of the chamber. Thereafter, the sample may be over pressured to maintain sample integrity.

Probe module 16 includes a plurality of probes 34, three of four being visible in FIG. 1, that are uniformly circumferentially distributed around probe module 16. Probes 34 facilitate testing, sampling and retrieval of fluids from the formation. Each probe 34 includes a sealing pad that makes contact with the formation. In certain embodiments, probes 34 are provided with at least one elongated sealing pad providing sealing contact with a surface of the borehole. Through one or more slits, fluid flow channels or recesses in the sealing pad, fluids from the sealed-off part of the formation surface may be collected within tester tool 10 through one or more inlets of the sealing pad and one or more fluid flow lines within probe module 16 and tool 10. The recess or recess in each pad may be elongated, preferably along the axis of the elongated pad and generally in the direction of the borehole axis.

Figure 3B:
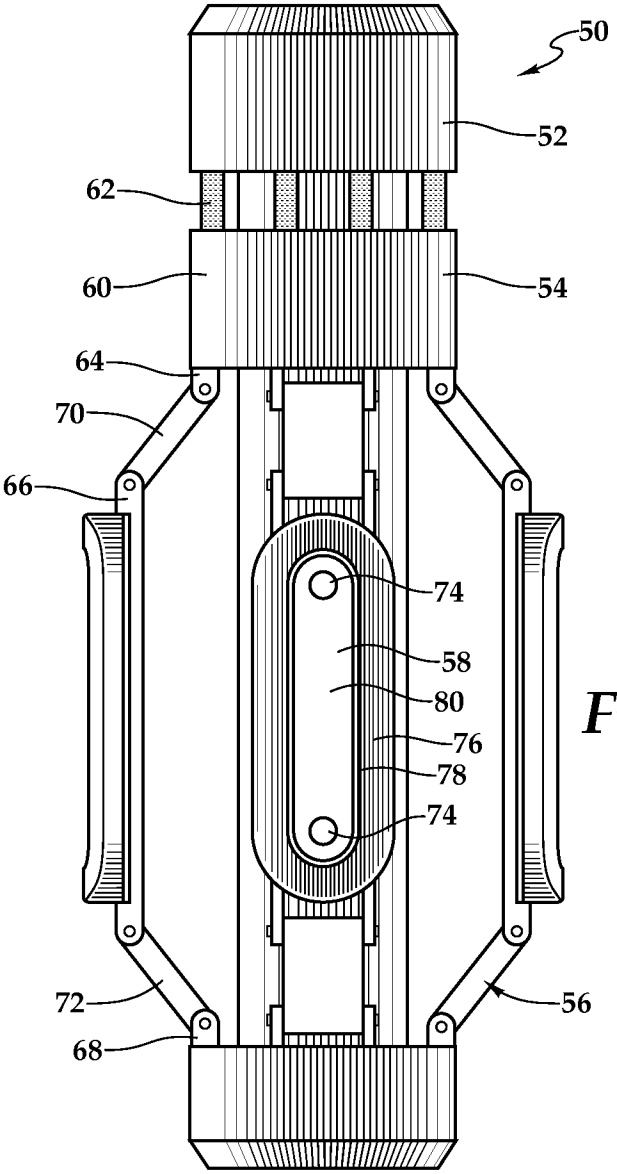
FIGS. 3A-3B are schematic illustrations of an embodiment of a probe module for use in a downhole formation testing and sampling apparatus in its running configuration and in its deployed configuration, respectively.
Figure 3A:
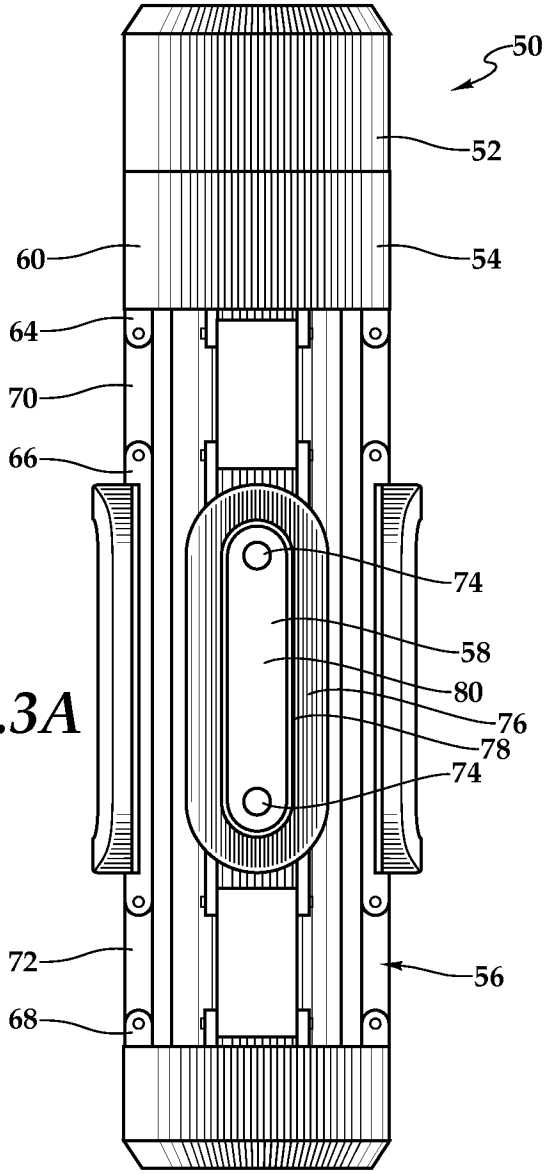

Referring now to FIGS. 3A-3B, therein is depicted one embodiment of a probe module in its radially contracted running configuration and its radially expanded deployed configuration, respectively, that is generally designated 50. In the illustrated embodiment, probe module 50 includes a actuation module 52, a setting assembly 54 including a linkage assembly 56 and a plurality of probes 58, three of four being visible in FIGS. 3A-3B, that are uniformly circumferentially distributed around probe module 50. In operation, a hydraulic pump or other pressure generating source is used to apply an axial compression force on a setting mandrel 60 via hydraulic cylinders 62. The axial compression force is transmitted to linkage assembly 56 causing radial deployment thereof. In the illustrated embodiment, each section of linkage assembly 56 includes a pair of upper connectors 64, a pair of probe connection rails 66 and a pair of lower connectors 68. Also, in the illustrated embodiment, each section of linkage assembly 56 includes an upper rotating arm 70 and a lower rotating arm 72. Upper rotating arm 70 extends between upper connectors 64 and probe connection rails 66 and forms an articulating connection with each of the upper connectors 64 and with each of the probe connection rails 66. Likewise, lower rotating arm 72 extends between lower connectors 68 and probe connection rails 66 and forms an articulating connection with each of the lower connectors 68 and each of the probe connection rails 66. As such, each probe 58 is radially deployed by a linkage member consisting of a pair of upper connectors 64, a pair of probe connection rails 66, a pair of lower connectors 68, an upper rotating arm 70 and a lower rotating arm 72. In the illustrated embodiment, linkage assembly 56 consists of four linkage members.

When the hydraulic pressure is increased by actuation module 52, hydraulic cylinders 62 apply an axial compression force on setting mandrel 60 and linkage assembly 56. The axial compression force causes upper rotating arms 70 to rotate relative to upper connectors 64 and probe connection rails 66. Likewise, the axial compression force causes lower rotating arms 72 to rotate relative to lower connectors 68 and probe connection rails 66. As best seen in FIG. 3B, this rotation causes probes 58 to be deployed radially outwardly, which establishes a hydraulic connection between probes 58 and the formation. Even though probe module 50 has been describe as having actuation module 52 positioned uphole of setting assembly 54, those skilled in the art will understand that a probe module 50 having an actuation module 52 positioned downhole of a setting assembly 54 is also possible and considered within the scope of the present disclosure.

Probes 58 facilitate testing, sampling and retrieval of fluids from the formation. Probes 58 may have high-resolution temperature compensated strain gauge pressure transducers (not visible in FIGS. 3A-3B) that can be isolated with shut-in valves (not visible in FIGS. 3A-3B) to monitor independent pressures associate with probes 58. In addition, other sensors such as resistivity or optical sensors (not visible in FIGS. 3A-3B) located near probes 58 may be used to monitor fluid properties immediately after fluid enters a probe 58. Probe module 50 generally allows retrieval and sampling of formation fluids in sections or regions of a formation along the longitudinal axis of the borehole. In the illustrated embodiment, each probe 58 includes two inlets 74 for independently obtaining fluid samples. Based upon the testing procedure being performed, the flow into the two inlets 74 of each probe 58 as well as the flow into each probe 58 may be maintained as independent or commingled as desired by operation of control valves and manifolding within tool 10. Likewise, the flow into or shut off of each inlet 74 of each probe 58 as well as the flow into or shut off of each probe 58 may be controlled by operation of control valves and manifolding within tool 10. The fluid control operation is generally monitored by the control unit. In the illustrated embodiment, each probe 58 includes an elongated sealing pad 76 for sealing off a portion or region on the sidewall of a borehole.

Sealing pads 76 are removably attached to probe 58 by suitable connection for easy replacement. Sealing pads 76 are preferably made of elastomeric material, such as rubber, compatible with the well fluids and the physical and chemical conditions expected to be encountered in an underground formation. Each sealing pad 76 includes a slot or recess 78 cut into the face of the pad having a rigid aperture plate with a raised lip referred to herein and described below as a steel aperture 80. The aforementioned two inlets 74 are cut through steel aperture 80. In some embodiments, a screen element, a gravel pack, sand pack or other filter medium may be positioned within steel aperture 80 to filter migrating solid particles such as sand and drilling debris from entering the tool. In the illustrated embodiment, sealing pads 76 provide a large exposure area to the formation for testing and sampling of formation fluids across laminations, fractures and vugs.

In operation, probe module 50 would be positioned in a tool string such as tool 10 described above. Tool 10 is conveyed into the borehole by means of wireline 28 or other suitable conveying means to a desired location or depth in the well. The actuation module 14 of tool 10 is then operated to transmit an axially compression force that radially deploys probes 58, thereby creating a hydraulic seal between sealing pads 76 and the wellbore wall at the zone of interest. Once sealing pads 76 of probes 58 are set, a pretest may be performed. The pretest involves, a pretest pump disposed with tool 10 used to draw a small sample of the formation fluid from the region sealed off by sealing pads 76 into the one or more flow lines of tool 10, while the fluid flow is monitored using pressure gauges. As the fluid sample is drawn into the flow lines, the pressure decreases due to the resistance of the formation to fluid flow. When the pretest stops, the pressure in the flow lines increases until it equalizes with the pressure in the formation. This is due to the formation gradually releasing the fluids into the probes 58. The pressure drawdown and buildup can be analyzed to determine formation pressure and permeability.

A formation's permeability and isotropy can be determined, for example, as described in U.S. Pat. No. 5,672,819, the content of which is incorporated herein by reference. For a successful performance of these tests, isolation between two inlets 74 of a probe 58 or between at least two probes 58 is preferred. The tests may be performed as follows. Each probe 58 is radially outwardly shifted to form a hydraulically sealed connection between its sealing pad 76 and the formation. Then, one inlet 74, for example, is isolated from the internal flow line by a control valve while the other inlet 74 is open to flow. Flow control module 20 then begins pumping formation fluid through probe 58. If flow control module 20 uses a piston pump that moves up and down, it generates a sinusoidal pressure wave in the contact zone between sealing pad 76 and the formation. The isolated inlet 74, located a short distance from the flowing inlet 74, senses properties of the wave to produce a time domain pressure plot, which is used to calculate the amplitude or phase of the wave. The tool then compares properties of the sensed wave with properties of the propagated wave to obtain values that can be used in the calculation of formation properties. For example, phase shift between the propagated and sensed wave or amplitude decay can be determined. These measurements can be related back to formation permeability and isotropy via known mathematical models.

It should be understood by those skilled in the art that probe module 50 enables improved permeability and isotropy estimation of reservoirs having heterogeneous matrices. Due to the large area of sealing pads 76, a correspondingly large area of the underground formation can be tested simultaneously, thereby providing an improved estimate of formation properties. For example, in laminated or turbidite reservoirs, in which a significant volume of oil or a highly permeable stratum is often trapped between two adjacent formation layers having very low permeabilities, elongated sealing pads 76 will likely cover several such layers. The pressure created by the pump, instead of concentrating at a single point in the vicinity of the fluid inlets, is distributed along recess 78, thereby enabling formation fluid testing and sampling in a large area of the formation hydraulically sealed by elongated sealing pads 76. Thus, even if there is a thin permeable stratum trapped between several low-permeability layers, such stratum will be detected and its fluids will be sampled. Similarly, in naturally fractured and vugular formations, formation fluid testing and sampling can be successfully accomplished over matrix heterogeneities. Such improved estimates of formation properties will result in more accurate prediction of a hydrocarbon reservoir's producibility.

To collect the fluid samples in the condition in which such fluid is present in the formation, the area near sealing pads 76 is flushed or pumped. The pumping rate of a double acting piston pump in flow control module 20 may be regulated such that the pressure in the flow line or lines (not pictured) near sealing pads 76 is maintained above a particular pressure of the fluid sample. Thus, while fluid samples are being obtained, the fluid testing devices of fluid testing module 18 can measure fluid properties. These devices preferably provide information about the contents of the fluid and the presence of any gas bubbles in the fluid to the control unit. By monitoring the gas bubbles in the fluid, the flow in the flow lines can be constantly adjusted to maintain a single-phase fluid in the flow lines. These fluid properties and other parameters, such as the pressure, temperature, density, viscosity, fluid composition and contamination, can be used to monitor the fluid flow while the formation fluid is being pumped for sample collection. When it is determined that the formation fluid flowing through the flow lines is representative of the in situ conditions, the fluid is then collected in fluid chambers 24.

When tool 10 is conveyed into the borehole, the borehole fluid may be allowed to enter the lower sections of fluid chambers 24 via port 38. This causes internal pistons to move as borehole fluid fills the lower sections of fluid chambers 24. This is because the hydrostatic pressure in the conduit connecting the lower sections of fluid chambers 24 and the borehole is greater than the pressure in the sample flow lines. Alternatively, the conduit can be closed by an electrically controlled valve and the lower sections of fluid chambers 24 can be filled with the borehole fluid after tool 10 has been positioned in the borehole. To collect the formation fluid in chambers 24, the piston pump in flow control module 20 is operated to selectively pump formation fluid into the sample flow lines through the various inlets 74 of probes 58. When the flow line pressure exceeds the hydrostatic pressure in the lower sections of fluid chambers 24, the formation fluid is routed to and starts to selectively fill the upper sections of fluid chambers 24. When the upper sections of fluid chambers 24 have been filled to a desired level, the valves connecting the chambers with the flow lines and the borehole are closed, which ensures that the pressure in chambers 24 remains at the pressure at which the fluid was collected therein. While one sampling procedure has been described, it should be recognize that other sampling procedures may be used depending upon the design of tool 10, the desired testing and sampling regime and other factors known to those skilled in the art.

The above-disclosed system for the estimation of relative permeability has significant advantages over known permeability estimation techniques. In particular, formation testing and sampling apparatus 10 combines both the pressure-testing capabilities of the known probe-type tool designs and large exposure volume of straddle packers. In addition, tool 10 is capable of testing, retrieval and sampling of large sections of a formation along the axis of the borehole, thereby improving, inter alia, permeability estimates in formations having heterogeneous matrices such as laminated, vugular and fractured reservoirs. Also, due to the tool's ability to test large sections of the formation at a time, the testing cycle time is much more efficient than the prior art tools. Further, the tool is capable of formation testing in any typical size borehole.

Figure 4B:
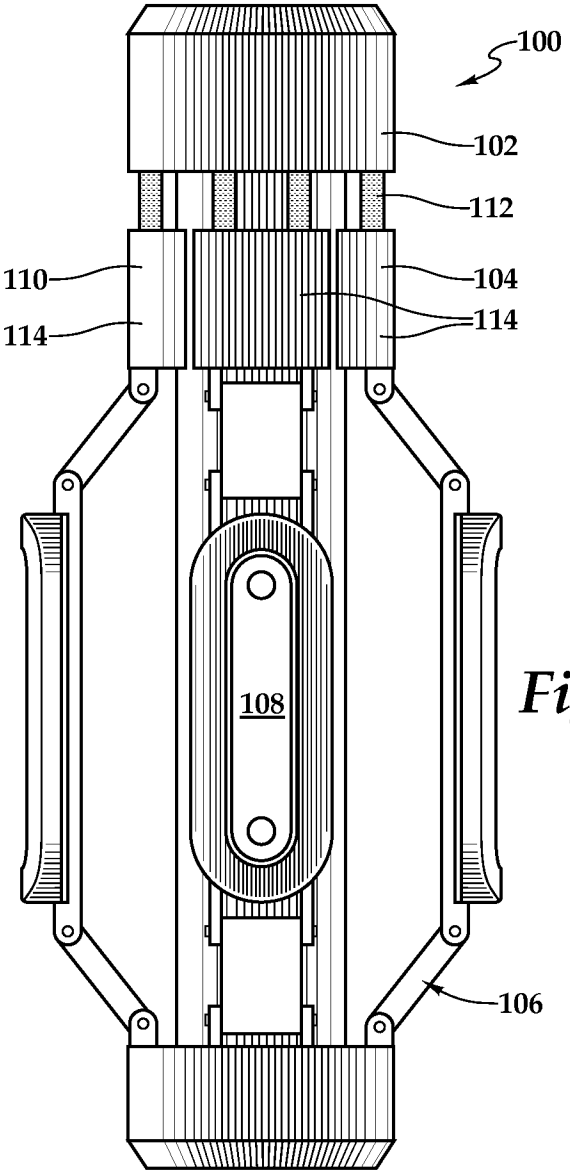
FIGS. 4A-4B are schematic illustrations of an embodiment of a probe module for use in a downhole formation testing and sampling apparatus in its running configuration and in its deployed configuration, respectively.
Figure 4A:
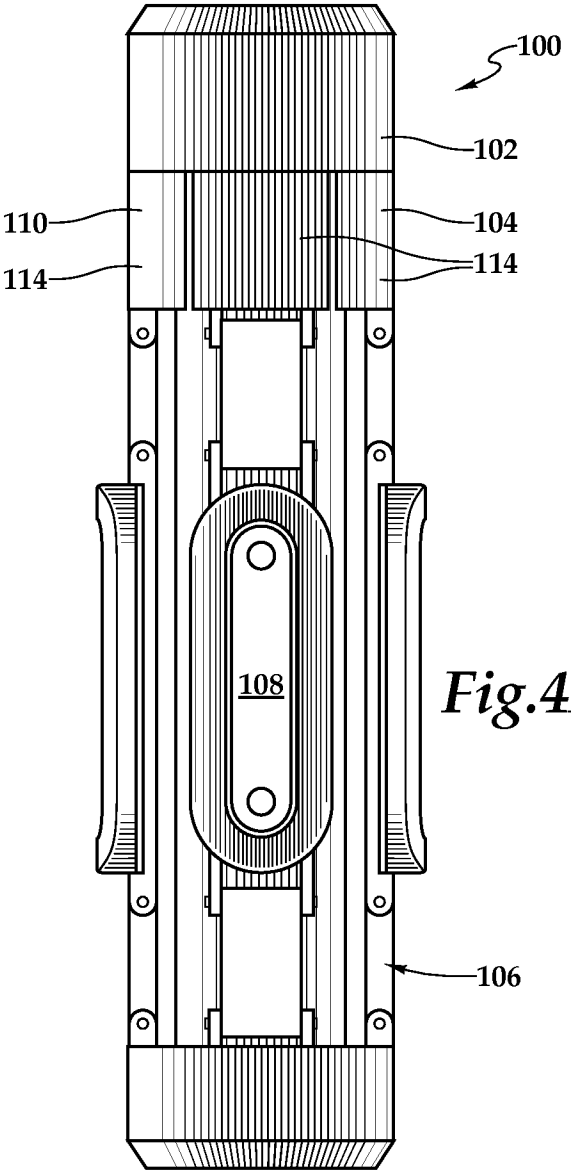

Even though FIGS. 3A-3B depict a probe module having four probes that are deployed by a common setting mandrel, it should be understood by those skilled in the art that other probe modules having other setting techniques are possible and are considered within the scope of the present disclosure. For example, referring to FIGS. 4A-4B, therein is depicted an embodiment of a probe module in its radially contracted running configuration and its radially expanded deployed configuration, respectively, that is generally designated 100. In the illustrated embodiment, probe module 100 includes an actuation module 102, a setting assembly 104 including a linkage assembly 106 and a plurality of probes 108, three of four being visible in FIGS. 4A-4B, that are uniformly circumferentially distributed around probe module 100. In operation, a hydraulic pump or other pressure generating source is used to apply an axial compression force on a setting mandrel 110 via hydraulic cylinders 112. In the illustrated embodiment, setting mandrel 110 has four independent mandrel sections 114, three of four being visible in FIGS. 4A-4B, that enable probe module 100 to account for certain nonuniformities in the surface of the wellbore. The axial compression force is transmitted to each linkage member of linkage assembly 106 on an independent basis causing independent radial deployment thereof. In this manner, application of the same axial compression force on each of the independent mandrel sections 114 may result in a different radial deployment of the associated probe 108 as each probe 108 may come into contact with and establish a hydraulic connection with the formation at a different radial distance due to variations in the roundness of the wellbore. Probes 108 thus facilitate testing, sampling and retrieval of fluids from the formation. In addition, a tool 10 including probe module 100 is capable of efficiently testing, retrieval and sampling of large sections of a formation along the axis of the borehole, thereby improving, inter alia, permeability estimates in formations having heterogeneous matrices such as laminated, vugular and fractured reservoirs.

Even though FIGS. 3A-3B and 4A-4B have depicted a probe module having a particular linkage assembly, it should be understood by those skilled in the art that other probe modules having other linkage assemblies are possible and are considered within the scope of the present disclosure. For example, referring to FIGS. 5A-5B, therein is depicted an embodiment of a probe module in its radially contracted running configuration and its radially expanded deployed configuration, respectively, that is generally designated 120. In the illustrated embodiment, probe module 120 includes an actuation module 122, a setting assembly 124 including a linkage assembly 126 and a plurality of probes 128, three of four being visible in FIGS. 5A-5B, that are uniformly circumferentially distributed around probe module 120. In operation, a hydraulic pump or other pressure generating source is used to apply an axial compression force on a setting mandrel 130 via hydraulic cylinders 132. The axial compression force is transmitted to linkage assembly 126 causing radial deployment thereof. In the illustrated embodiment, each section of linkage assembly 126 includes a pair of upper connectors 134, a pair of probe connection rails 136 and a pair of lower connectors 138. Also, in the illustrated embodiment, each section of linkage assembly 126 includes a pair of upper rotating arms 140 and a pair of lower rotating arm 142. Each upper rotating arm 140 extends between an upper connector 134 and a lower connector of a probe connection rail 136 and forms an articulating connection with one of the upper connectors 134 and with one of the probe connection rails 136. Likewise, each lower rotating arm 142 extends between a lower connector 138 and an upper connection of a probe connection rails 136 and forms an articulating connection with one of the lower connectors 138 and with one of the probe connection rails 136. As such, each probe 128 is radially deployed by a linkage member consisting of a pair of upper connectors 134, a pair of probe connection rails 136, a pair of lower connectors 138, a pair of upper rotating arm 140 and a pair of lower rotating arm 142. In the illustrated embodiment, linkage assembly 126 consists of four linkage members.

Figure 5B:
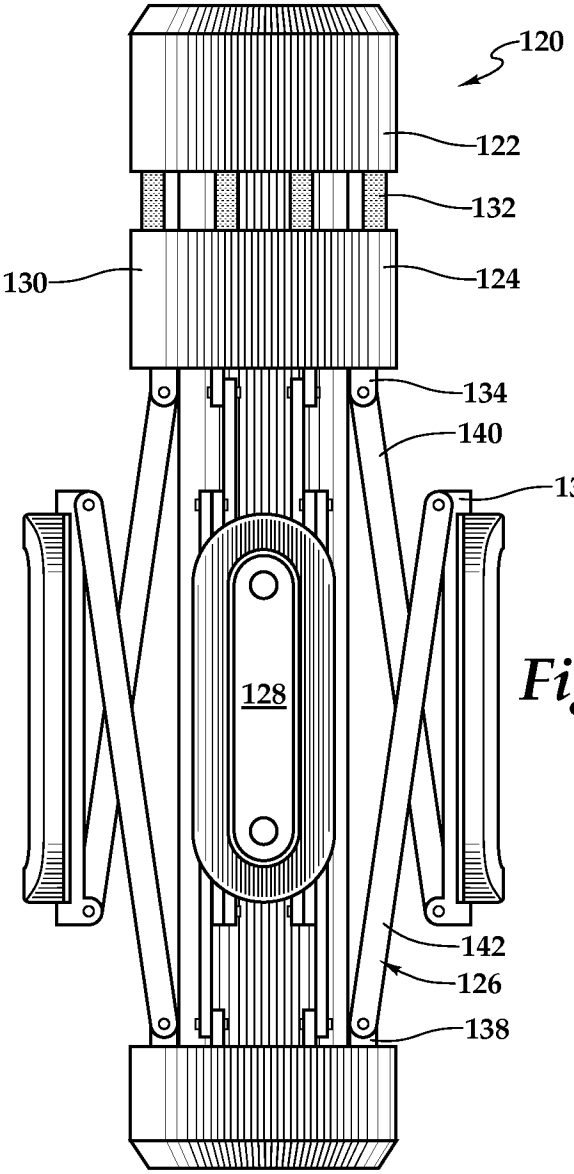
FIGS. 5A-5B are schematic illustrations of an embodiment of a probe module for use in a downhole formation testing and sampling apparatus in its running configuration and in its deployed configuration, respectively.
Figure 5A:
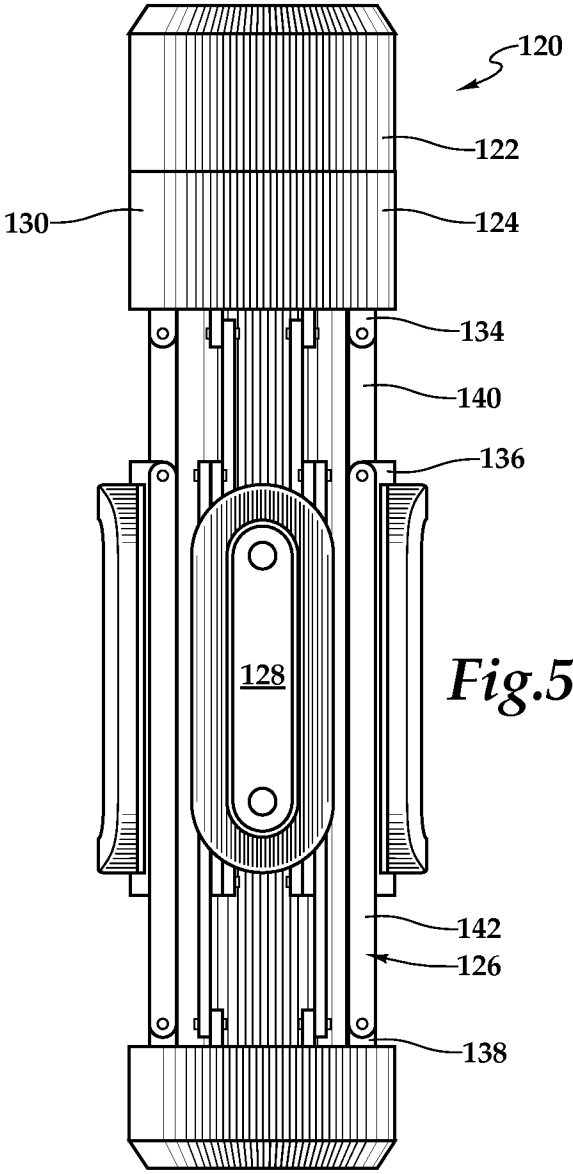

When hydraulic pressure is increased within actuation module 122, hydraulic cylinders 132 apply an axial compression force on setting mandrel 130 and linkage assembly 126. The axial compression force causes each upper rotating arm 140 to rotate relative to its upper connector 134 and its probe connection rail 136. Likewise, the axial compression force causes each lower rotating arm 142 to rotate relative to its lower connector 138 and its probe connection rail 136. As best seen in FIG. 5B, this rotation causes probes 128 to be deployed radially outwardly, which establishes a hydraulic connection between probes 128 and the formation. Probes 128 thus facilitate testing, sampling and retrieval of fluids from the formation. In addition, a tool 10 including probe module 120 is capable of efficiently testing, retrieval and sampling of large sections of a formation along the axis of the borehole, thereby improving, inter alia, permeability estimates in formations having heterogeneous matrices such as laminated, vugular and fractured reservoirs.

Even though FIGS. 3A-3B, 4A-4B and 5A-5B have depicted probe modules having four probes that are circumferentially distributed uniformly therearound, it should be understood by those skilled in the art that other probe modules having other numbers of probes and/or having probes in other orientations are possible and are considered within the scope of the present disclosure. For example, referring to FIG. 6A-6B, therein is depicted an embodiment of a probe module in its radially contracted running configuration and its radially expanded deployed configuration, respectively, that is generally designated 150. In the illustrated embodiment, probe module 150 includes an actuation module 152, a setting assembly 154 including a linkage assembly 156, a first set of probes 158, three of four being visible in FIGS. 6A-6B, that are uniformly circumferentially distributed around probe module 150 and a second set of probes 160, three of four being visible in FIGS. 6A-6B, that are uniformly circumferentially distributed around probe module 150. In the illustrated embodiment, probes 158 and probes 160 form two longitudinally separated arrays of probes. In operation, a hydraulic pump or other pressure generating source is used to apply an axial compression force on a setting mandrel 162 via hydraulic cylinders 164. The axial compression force is transmitted to linkage assembly 156, which results in radial deployment of probes 158, 160 establishing hydraulic connections with the formation. Together, probes 158 and probes 160 facilitate testing, sampling and retrieval of fluids from the formation. In addition, a tool 10 including probe module 150 is capable of efficiently testing, retrieval and sampling of large sections of a formation along the axis of the borehole, thereby improving, inter alia, permeability estimates in formations having heterogeneous matrices such as laminated, vugular and fractured reservoirs.

Figure 6A:
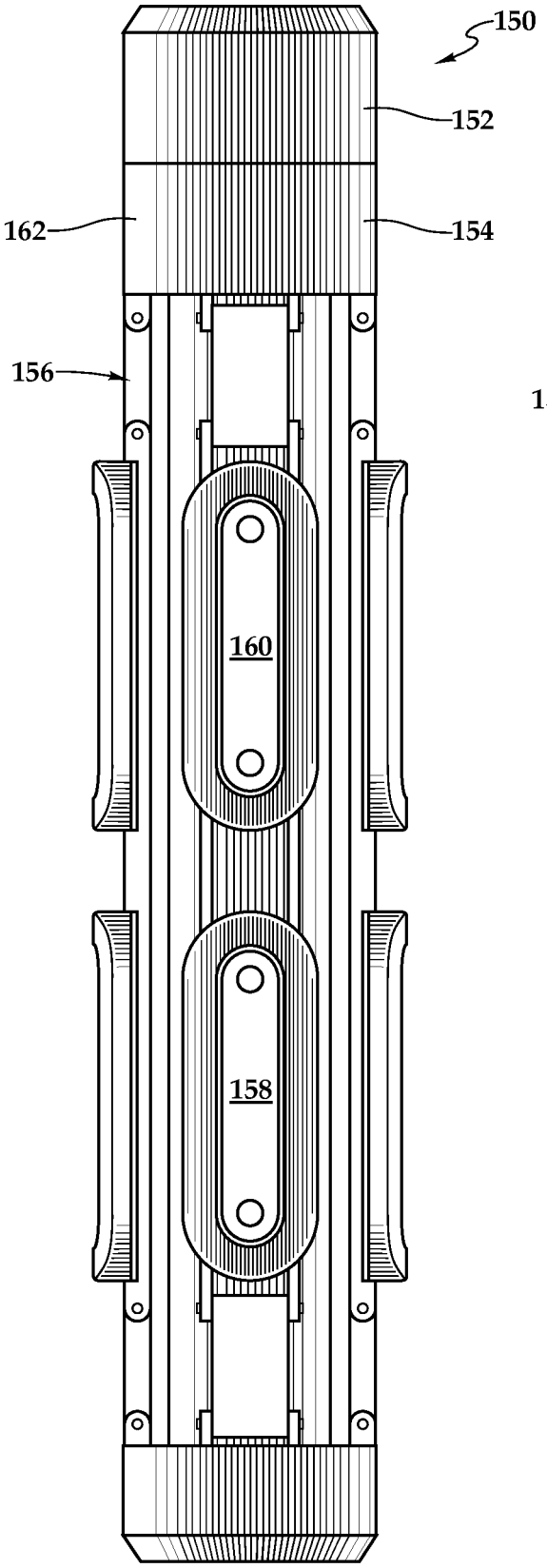
FIGS. 6A-6B are schematic illustrations of an embodiment of a probe module for use in a downhole formation testing and sampling apparatus in its running configuration and in its deployed configuration, respectively.
Figure 6B:
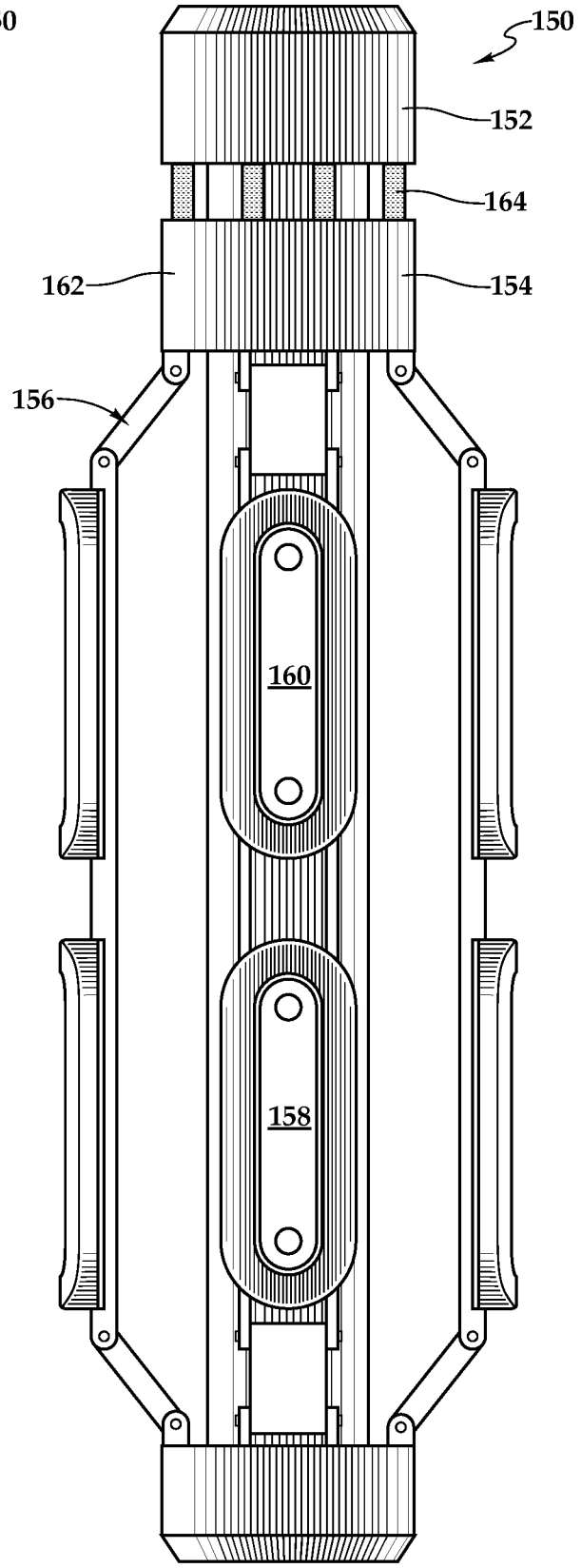
Figure 7A:
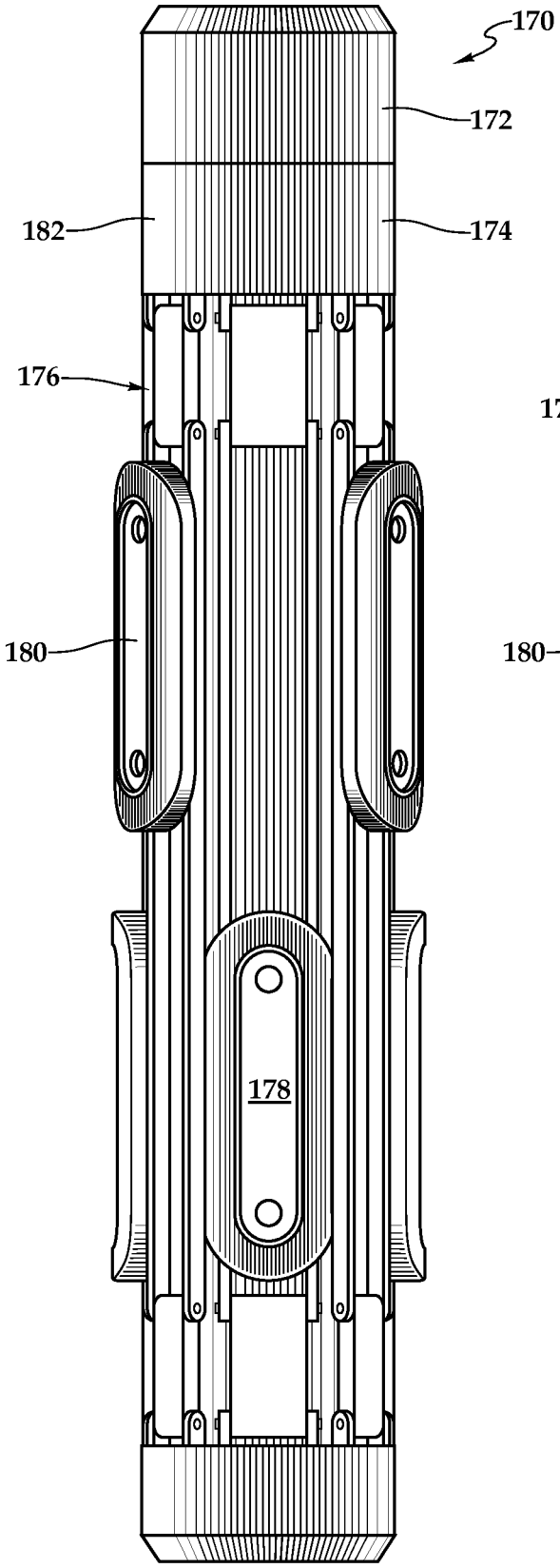
FIGS. 7A-7B are schematic illustrations of an embodiment of a probe module for use in a downhole formation testing and sampling apparatus in its running configuration and in its deployed configuration, respectively.
Figure 7B:
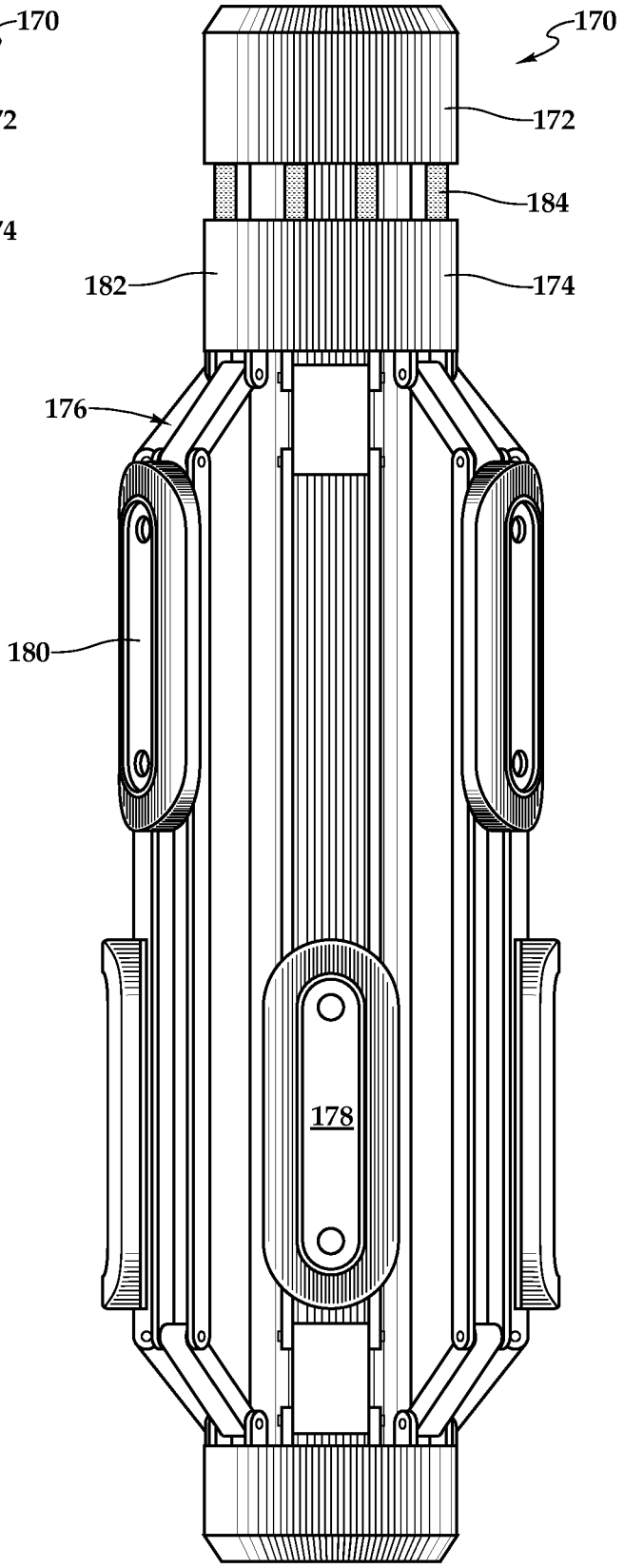

Even though FIGS. 6A-6B depict a probe module having two arrays of four probes that are circumferentially distributed uniformly thereabout and longitudinally aligned with one another, it should be understood by those skilled in the art that other probe modules having other numbers of probes and/or having probes in other orientations are possible and are considered within the scope of the present disclosure. For example, referring to FIGS. 7A-7B, therein is depicted an embodiment of a probe module in its radially contracted running configuration and its radially expanded deployed configuration, respectively, that is generally designated 170. In the illustrated embodiment, probe module 170 includes an actuation module 172, a setting assembly 174 including a linkage assembly 176, a first set of probes 178, three of four being visible in FIGS. 7A-7B, that are uniformly circumferentially distributed around probe module 170 and a second set of probes 180, two of four being visible in FIGS. 7A-7B, that are uniformly circumferentially distributed around probe module 170. In the illustrated embodiment, probes 178 and probes 180 form two longitudinally separated arrays of probes that are phased at 45 degrees from one another. In operation, a hydraulic pump or other pressure generating source is used to apply an axial compression force on a setting mandrel 182 via hydraulic cylinders 184. The axial compression force is transmitted to linkage assembly 176, which results in radial deployment of probes 178, 180 establishing hydraulic connections with the formation. Together, probes 178 and probes 180 facilitate testing, sampling and retrieval of fluids from the formation. In addition, a tool 10 including probe module 170 is capable of efficiently testing, retrieval and sampling of large sections of a formation along the axis of the borehole, thereby improving, inter alia, permeability estimates in formations having heterogeneous matrices such as laminated, vugular and fractured reservoirs.

Use of probe modules 50, 100, 120, 150, 170 enable the performance of a variety of test regimes by enabling isolation of specific probes and/or specific inlets of the various probes to obtain information relative to the various sealed regions of the wellbore. For example, pressure gradient tests may be performed in which formation fluid is drawn into one or more probes and changes in pressure are detected at other probes that are isolated from the probes drawing fluid. As described above, fluid isolation between the probes or between inlets of the probes may be accomplished by the control unit. Additionally, formation anisotropy can be determined by observing pressure changes between probes during flowing periods or during pressure buildup periods. In addition, by having multiple probes it is possible to determine the direction or tensor of the anisotropy.

Referring next to FIGS. 8A-8F, therein are depicted various views of an embodiment of a probe that is generally designated 200. Probe 200 has a rigid base 202 and a pair of connection rails 204 that enable connection of probe 200 within a linkage assembly, as discussed above. Rigid base 202 and connection rails 204 are securably connected together by suitable means such as bolting, welding or the like. Probe 200 has an elastomeric sealing pad 206 that is securably attached to rigid base 202. As described above, sealing pad 206 has an elongated structure with a recess 208.

Figure 8A:
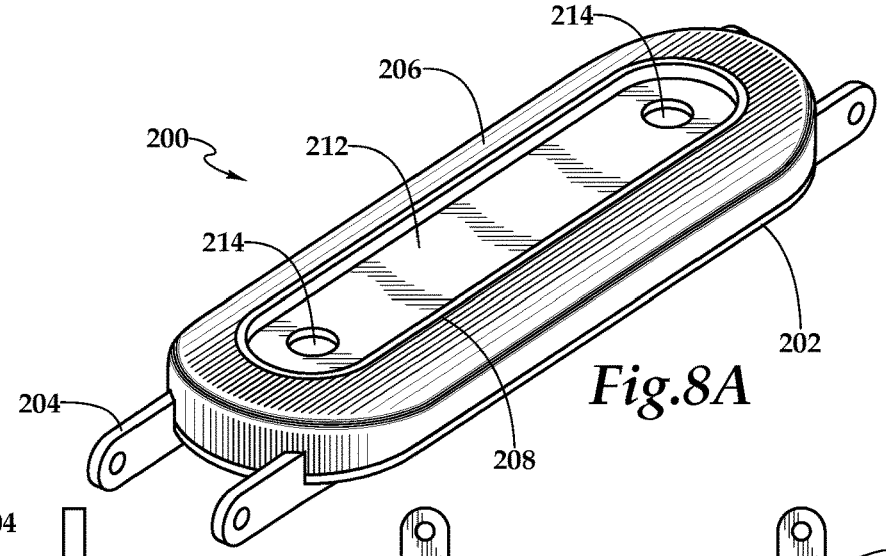
FIGS. 8A-8F are various views of an embodiment of a probe for use in a downhole formation testing and sampling apparatus.
Figure 8B:
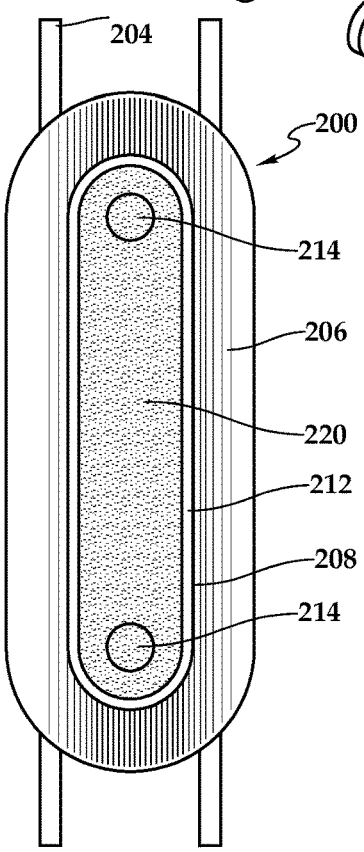
Figure 8C:
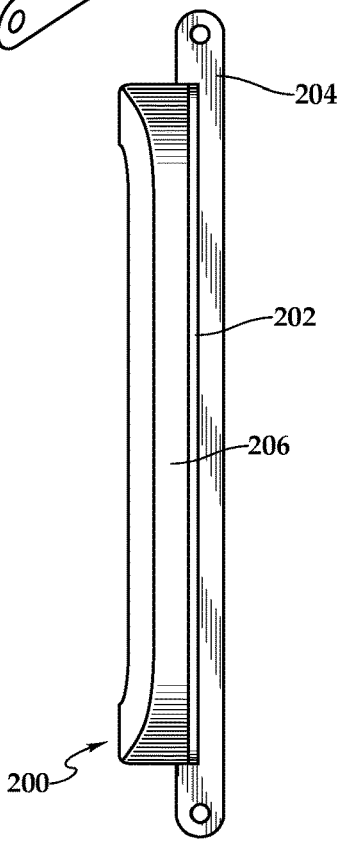
Figure 8E:
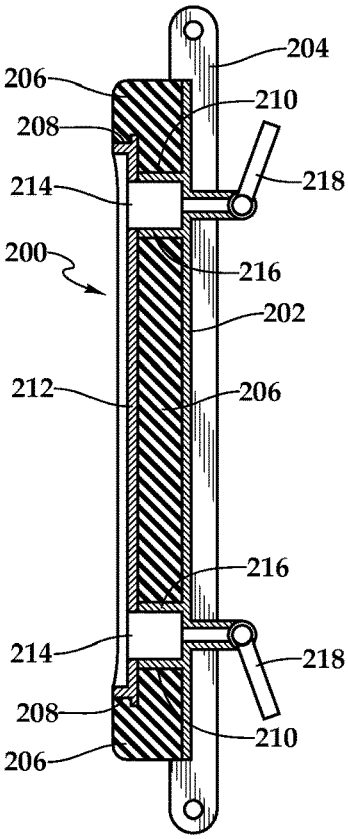
Figure 8D:
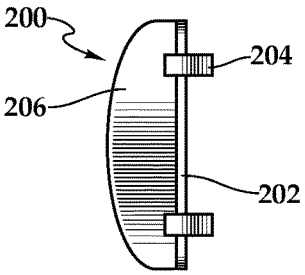
Figure 8F:
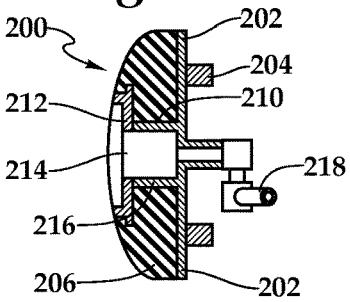

In addition, sealing pad 206 has a pair of openings 210, as best seen in FIGS. 8E and 8F. Sealing pad 206 has a radius of curvature designed to generally match that of the borehole into which sealing pad 206 is deployed, as best seen in FIGS. 8C, 8D and 8F. As illustrated, recess 208 has a steel aperture 212 that is securably disposed therein. Steel aperture 212 is attached to sealing pad 206. In the illustrated embodiment, steel aperture 212 is supported by rigid base 202, as best seen in FIGS. 8E and 8F. Alternatively, steel aperture 212 could be supported by connection rails 204. Steel aperture 212 may have an optional screen element 220 positioned therein, such as a gravel pack, a sand pack or other filter medium that is operable to filter migrating solid particles such as sand and drilling debris from entering tool 10, only depicted in FIG. 8B.

Steel aperture 212 has a pair of inlets 214 that align with fluid passageways 216, as best seen in FIGS. 8E and 8F. Fluid passageways 216 are fluidically coupled to flow lines 218 of tool 10 enabling formation fluids entering inlets 214 to be routed within and tested by tool 10. As illustrated, flow lines 218 have a rotating connection with fluid passageways 216. In alternate embodiments, flow lines 218 may have an articulating connection, a telescopic connection or the like that enables the deployment of probe 200 in the manner described above while maintaining the fluid connection between flow lines 218 and fluid passageways 216. Alternatively or additionally, flow lines 218 may be flexible. In operation, when the setting assembly is hydraulically actuated, sealing pad 206 and steel aperture 212 are radially outwardly shifted into contact with the surface of the wellbore. More specifically, the axial compression force applied to the setting assembly creates a radial force between probe 200 and the wellbore surface, causing sealing pad 206 and steel aperture 212 to contact the surface of the wellbore. It will be appreciated that steel aperture 212 is pressed against the borehole wall with greater force than the elastomeric material of sealing pad 206. This system of deployment insures that steel aperture 212 keeps the rubber from extruding and creates a more effective seal.

Figure 9A:
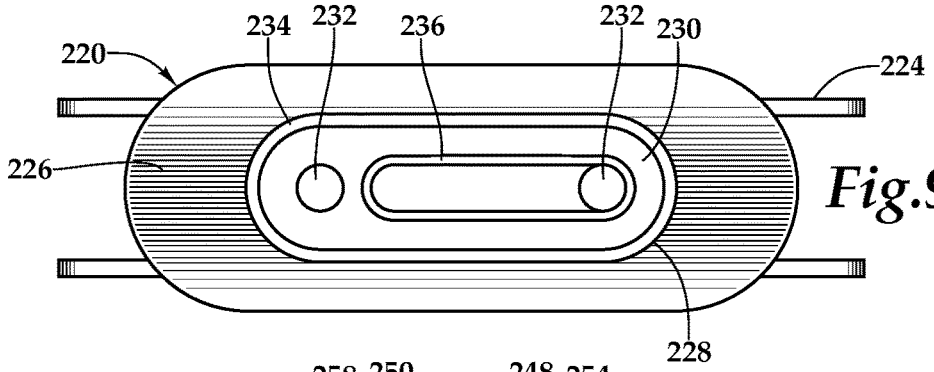
FIGS. 9A-9E are schematic illustrations of various embodiments of probes for use in a downhole formation testing and sampling apparatus.

Referring next to FIGS. 9A-9E, therein are depicted various embodiments of probes that are operable for use with the above described probe modules 16, 50, 100, 120, 150, 170 and the downhole formation testing and sampling apparatus 10. Probe 220 has a rigid base (not visible) and a pair of connection rails 224 that enable connection of probe 220 within a linkage assembly, as best seen in FIG. 9A. Probe 220 has an elastomeric sealing pad 226 that is securably attached to the rigid base. Sealing pad 226 has an elongated structure with a recess 228. Recess 228 has a steel aperture 230 that is securably disposed therein and attached to sealing pad 226. Steel aperture 230 has a pair of inlets 232. In addition, steel aperture 230 has a pair of raised lips, an outer lip 234 and an inner lip 236. In this embodiment, when probe 220 is in hydraulic connection with the formation, outer lip 234 forms a first sealed region and first fluid communication channel with the formation and inner lip 236 forms a second sealed region and second fluid communication channel with the formation allowing for independent fluid flow into each of the inlets 232. For example, the outer sealed region may be flowed at one drawdown pressure while the inner sealed region may be flowed at a different drawdown pressure. In certain embodiments, outer lip 234, inner lip 236 or both may include an elastomeric element to improve sealing.

Figure 9B:
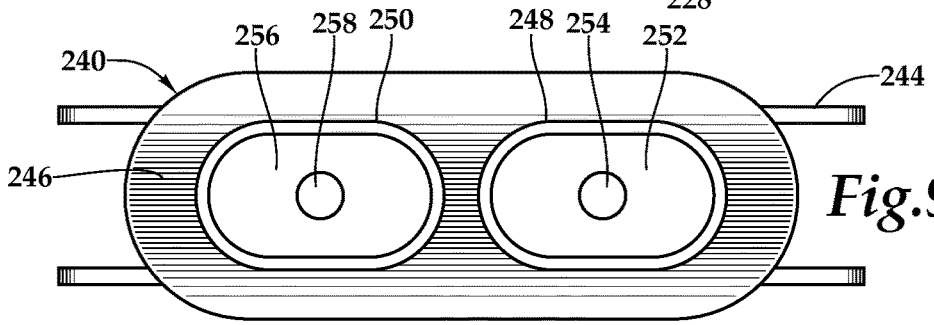

Probe 240 has a rigid base (not visible) and a pair of connection rails 244 that enable connection of probe 240 within a linkage assembly, as best seen in FIG. 9B. Probe 240 has an elastomeric sealing pad 246 that is securably attached to the rigid base. Sealing pad 246 has an elongated structure with a pair of recesses 248, 250. Recess 248 has a steel aperture 252 that is securably disposed therein and attached to sealing pad 246. Steel aperture 252 has a single inlet 254. Likewise, recess 250 has a steel aperture 256 that is securably disposed therein and attached to sealing pad 246. Steel aperture 256 has a single inlet 258. In this embodiment, when probe 240 is in hydraulic connection with the formation, steel aperture 252 forms a first sealed region and first fluid communication channel with the formation and steel aperture 256 forms a second sealed region and second fluid communication channel with the formation allowing for independent fluid flow into each of the inlets 254, 258.

Figure 9C:
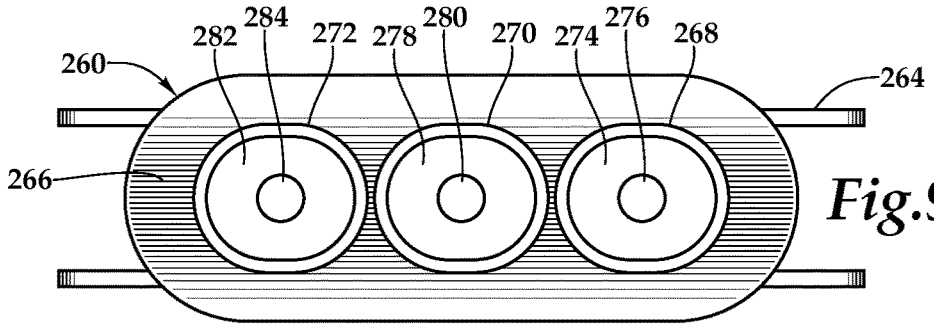

Probe 260 has a rigid base (not visible) and a pair of connection rails 264 that enable connection of probe 260 within a linkage assembly, as best seen in FIG. 9C. Probe 260 has an elastomeric sealing pad 266 that is securably attached to the rigid base. Sealing pad 266 has an elongated structure with three recesses 268, 270, 272. Recess 268 has a steel aperture 274 that is securably disposed therein and attached to sealing pad 266. Steel aperture 274 has a single inlet 276. Likewise, recess 270 has a steel aperture 278 that is securably disposed therein and attached to sealing pad 266. Steel aperture 278 has a single inlet 280. Further, recess 272 has a steel aperture 282 that is securably disposed therein and attached to sealing pad 266. Steel aperture 282 has a single inlet 284. In this embodiment, when probe 260 is in hydraulic connection with the formation, steel aperture 274 forms a first sealed region and first fluid communication channel with the formation, steel aperture 278 forms a second sealed region and second fluid communication channel with the formation and steel aperture 282 forms a third sealed region and third fluid communication channel with the formation allowing for independent fluid flow into each of the inlets 276, 280, 284.

Figure 9D:
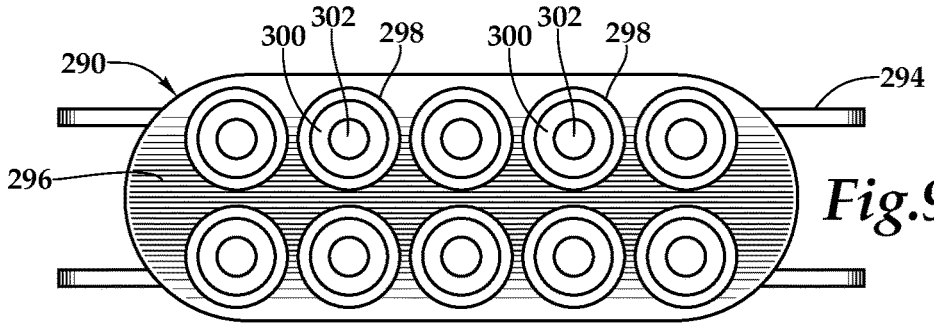

Probe 290 has a rigid base (not visible) and a pair of connection rails 294 that enable connection of probe 290 within a linkage assembly, as best seen in FIG. 9D. Probe 290 has an elastomeric sealing pad 296 that is securably attached to the rigid base. Sealing pad 296 has an elongated structure with a 2×5 array of recesses 298. Each of the recesses 298 has a steel aperture 300 that is securably disposed therein and attached to sealing pad 296. Each steel aperture 300 has a single inlet 302. In this embodiment, when probe 290 is in hydraulic connection with the formation, each steel aperture 300 forms a sealed region and fluid communication channel with the formation allowing for independent fluid flow into each of the inlets 302.

Figure 9E:
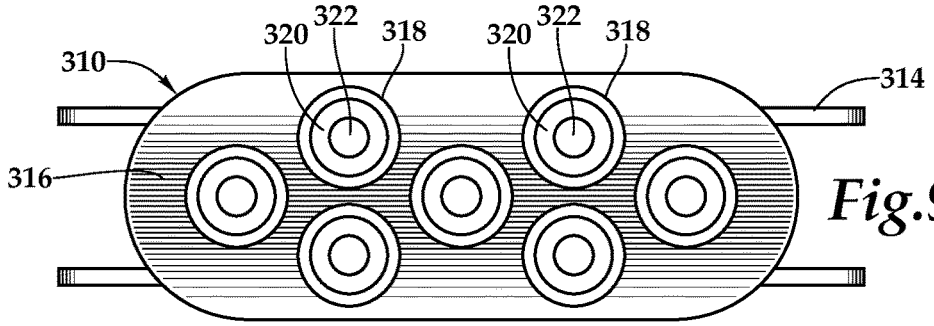

Even though FIG. 9D has depicted a probe having a particular number of recesses in a uniform array, those skilled in the art will understand that other probes could have other arrangements of other numbers of recesses. For example, probe 310 has a rigid base (not visible) and a pair of connection rails 314 that enable connection of probe 310 within a linkage assembly, as best seen in FIG. 9E. Probe 310 has an elastomeric sealing pad 316 that is securably attached to the rigid base. Sealing pad 316 has an elongated structure with a non-uniform array of seven recesses 318. Each of the recesses 318 has a steel aperture 320 that is securably disposed therein and attached to sealing pad 316. Each steel aperture 320 has a single inlet 322. In this embodiment, when probe 310 is in hydraulic connection with the formation, each steel aperture 320 forms a sealed region and fluid communication channel with the formation allowing for independent fluid flow into each of the inlets 322.

Figure 10A:
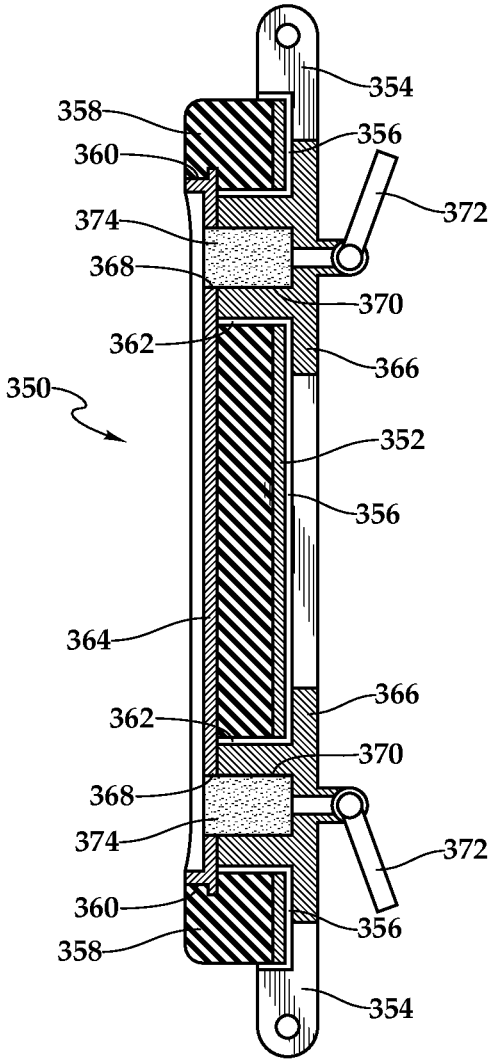
FIGS. 10A-10B are cross sectional views of an embodiment of a probe for use in a downhole formation testing and sampling apparatus.
Figure 10B:
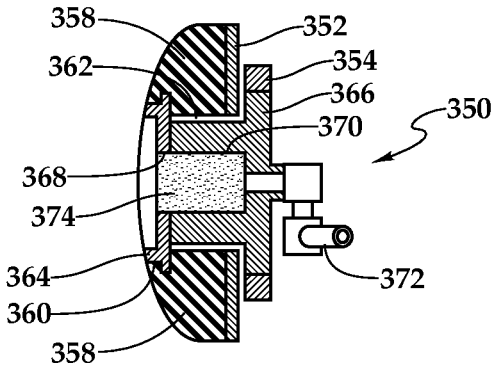

Referring next to FIGS. 10A-10B, therein are depicted cross sectional views of an embodiment of a probe that is generally designated 350. Probe 350 has a rigid base 352 and a pair of connection rails 354 that enable connection of probe 350 within a linkage assembly, as discussed above. In this embodiment, rigid base 352 and connection rails 354 are not connected together but instead have a gap 356 therebetween. Probe 350 has an elastomeric sealing pad 358 that is securably attached to rigid base 352. As described above, sealing pad 358 has an elongated structure with a recess 360. In addition, sealing pad 358 has a pair of openings 362. Sealing pad 358 has a radius of curvature designed to generally match that of the borehole into which sealing pad 358 is deployed. As illustrated, recess 360 has a steel aperture 364 that is securably disposed therein. Steel aperture 364 is attached to sealing pad 358. In the illustrated embodiment, steel aperture 364 is operably connected to connection rails 354 by support member 366. Steel aperture 364 has a pair of inlets 368 that align with fluid passageways 370. Fluid passageways 370 are fluidically coupled to flow lines 372 of tool 10 enabling formation fluids entering inlets 368 to be routed within and tested by tool 10. Fluid passageways 370 may have an optional screen element 374 such as a gravel pack, sand pack or other filter medium positioned therein to filter migrating solid particles such as sand and drilling debris from entering tool 10. Screen elements 374 may be an alternative to or in addition to a screen element disposed within the steel aperture such as screen element 220 discussed above.

In operation, when the setting assembly is hydraulically actuated, the elastomeric material of sealing pad 358 and steel aperture 364 are radially outwardly shifted into contact with the surface of the wellbore. More specifically, the axial compression force applied to the setting assembly creates a radial force between probe 350 and the wellbore surface, causing sealing pad 358 and steel aperture 364 to contact the surface of the wellbore. As steel aperture 364 is operably coupled to rails 354, steel aperture 364 is pressed against the borehole wall with greater force than the elastomeric material of sealing pad 358. With continued radial force, gap 356 between rigid base 352 and connection rails 354 is closed such that connection rails 354 contact rigid base 352. In this configuration, additional radial force may be applied to sealing pad 358 to enhance the hydraulic connection between probe 350 and the surface of the wellbore.

It should be understood by those skilled in the art that the illustrative embodiments described herein are not intended to be construed in a limiting sense. Various modifications and combinations of the illustrative embodiments as well as other embodiments will be apparent to persons skilled in the art upon reference to this disclosure. It is, therefore, intended that the appended claims encompass any such modifications or embodiments.

What is claimed is:

1. A downhole formation testing and sampling apparatus, comprising:

a setting assembly actuable between a radially contracted running configuration and a radially expanded deployed configuration;

an actuation module operably associated with the setting assembly and operable to apply an axially compressive force to the setting assembly to actuate the setting assembly from the running configuration to the deployed configuration; and a probe coupled to the setting assembly and including a sealing pad having an outer surface, the outer surface being operable to seal a region along a surface of the downhole formation when the setting assembly is in the deployed configuration so that a hydraulic connection is established between the probe and the downhole formation;

wherein the sealing pad includes a recess formed adjacent, and interior to, the outer surface, the recess defining a recessed surface in the sealing pad and being operable to receive fluid flow from the downhole formation when the outer surface seals the region along the surface of the downhole formation;

wherein the sealing pad further includes an opening extending from the recess and through a portion of the recessed surface to establish fluid communication between the recess and an interior of the apparatus;

wherein the sealing pad further comprises an elastomeric material;

wherein the elastomeric material of the sealing pad is reinforced with a rigid aperture plate defining opposing first and second surfaces;

wherein an inlet is formed through the rigid aperture plate, including the first and second surfaces;

wherein the rigid aperture plate is disposed within the recess of the sealing pad so that the inlet of the rigid aperture plate is aligned with the opening of the sealing pad; and wherein a first screen element is positioned within the inlet to filter migrating solid particles from entering the interior of the apparatus.

2. The apparatus as recited in claim 1 wherein the setting assembly further comprises a setting mandrel and a linkage assembly, wherein the probe is coupled to the linkage assembly and wherein axial shifting of the setting mandrel responsive to the axial compressive force causes radial deployment of the linkage assembly and the probe.

3. The apparatus as recited in claim 2 wherein the linkage assembly further comprises at least two rotating arms.

4. The apparatus as recited in claim 1 further comprising a fluid collection chamber for storing samples of retrieved fluids.

5. The apparatus as recited in claim 1 wherein the rigid aperture plate is made of steel.

6. The apparatus as recited in claim 1 further comprising a sensor for determining a property of the collected fluid.

7. The apparatus as recited in claim 1 wherein the sealing pad further comprises a filter medium.

8. The apparatus as recited in claim 1 wherein the region is elongated and is oriented along a longitudinal axis of a borehole.

9. A downhole formation testing and sampling apparatus, comprising:

a setting assembly actuable between a radially contracted running configuration and a radially expanded deployed configuration;

an actuation module operably associated with the setting assembly and operable to apply an axially compressive force to the setting assembly to actuate the setting assembly from the running configuration to the deployed configuration; and first and second probes coupled to the setting assembly, the first and second probes each including a sealing pad having an outer surface, the outer surfaces being operable to seal respective regions along respective surfaces of the downhole formation when the setting assembly is in the deployed configuration so that hydraulic connections are established between the first and second probes and the downhole formation;

wherein each of the sealing pads includes a recess formed adjacent, and interior to, the outer surface, the recess defining a recessed surface in the sealing pad and being operable to receive fluid flow from the downhole formation when the outer surfaces seal the respective regions along the respective surfaces of the downhole formation;

wherein each of the sealing pads further includes an opening extending from the recess and through a portion of the recessed surface to establish fluid communication between the recess and an interior of the apparatus;

wherein the setting assembly comprises:

a setting mandrel; and a linkage assembly, comprising:

first and second connectors coupled to the setting mandrel;

third and fourth connectors;

first and second rotating arms coupling the first and second probes, respectively, to the first and second connectors, respectively; and third and fourth rotating arms coupling the first and second probes, respectively, to the third and fourth connectors, respectively;

wherein the first probe extends closer to the first and third connectors, respectively, than to the second and fourth connectors, respectively;

wherein the second probe extends closer to the second and fourth connectors, respectively, than to the first and third connectors, respectively;

wherein axial shifting of the setting mandrel responsive to the axial compressive force causes radial deployment of the linkage assembly and the first and second probes so that:

the first and third rotating arms are angled relative to each other; and the second and fourth rotating arms are angled relative to each other;

and wherein the setting mandrel is radially divided into a plurality of separate mandrel sections each independently operable to radially deploy a portion of the linkage assembly and a portion of the first and second probes.

10. The apparatus as recited in claim 9 wherein the first and second probes are circumferentially distributed about the setting assembly.

11. The apparatus as recited in claim 9 wherein the first and second probes are uniformly circumferentially distributed about the setting assembly.

12. The apparatus as recited in claim 9 wherein the first and second probes are longitudinally distributed about the setting assembly.

13. The apparatus as recited in claim 9 wherein the first and second probes are circumferentially and longitudinally distributed about the setting assembly.

14. A method of testing and sampling formation fluid, comprising:

running a formation testing and sampling apparatus into a borehole that traverses a subterranean formation, the apparatus including a setting assembly, an actuation module operably associated with the setting assembly, and a probe coupled to the setting assembly, the probe including a sealing pad;

applying, using the actuation module, an axially compressive force to the setting assembly to actuate the setting assembly from a radially contracted running configuration to a radially expanded deployed configuration;

sealing, using an outer surface of the sealing pad, a region along a surface of the formation to establish a hydraulic connection between the probe and the formation, the sealing pad including a recess formed adjacent, and interior to, the outer surface, the recess defining a recessed surface in the sealing pad and being operable to receive fluid flow from the formation, and the sealing pad further including an opening extending from the recess and through a portion of the recessed surface to establish fluid communication between the recess and an interior of the apparatus; and drawing fluid from the region of the formation into the apparatus;

wherein the sealing pad further comprises an elastomeric material;

wherein the elastomeric material of the sealing pad is reinforced with a rigid aperture plate defining opposing first and second surfaces;

wherein an inlet is formed through the rigid aperture plate, including the first and second surfaces;

wherein the rigid aperture plate is disposed within the recess of the sealing pad so that the inlet of the rigid aperture plate is aligned with the opening of the sealing pad; and wherein a first screen element is positioned within the inlet to filter migrating solid particles from entering the interior of the apparatus.

15. The method as recited in claim 14 wherein actuating the actuation module to apply the axial compressive force to the setting assembly further comprises axial shifting a setting mandrel.

16. The method as recited in claim 15 wherein shifting the setting assembly from the radially contracted running configuration to the radially expanded deployed configuration further comprises radially deploying a linkage assembly.

17. The method as recited in claim 16 wherein radially deploying the linkage assembly further comprises rotating at least two rotating arms.

18. The apparatus as recited in claim 1 wherein the portion of the rigid aperture plate extending into the opening of the sealing pad to form the inlet is integrally formed with the remainder of the rigid aperture plate.

19. The apparatus as recited in claim 1 wherein a second screen element is positioned adjacent the rigid aperture plate to filter migrating solid particles from entering the inlet.

20. The apparatus as recited in claim 2 wherein the linkage assembly comprises:

first and second connectors coupled to the setting mandrel and axially shiftable therewith, first and second probe connection rails to which the probe is coupled, third and fourth connectors, an upper rotating arm extending between the first and second connectors and the first and second probe connection rails to form an articulating connection between the first and/or second connectors and the first and/or second probe connection rails, and a lower rotating arm extending between the third and fourth connectors and the first and second probe connection rails to form an articulating connection between the third and/or fourth connectors and the first and/or second probe connection rails.

21. The method as recited in claim 14 wherein a portion of the rigid aperture plate is pressed against the region to facilitate the establishment of the hydraulic connection between the probe and the formation, and to prevent, or at least reduce extrusion of the sealing pad.

22. The method as recited in claim 14 wherein the portion of the rigid aperture plate extending into the opening of the sealing pad to form the inlet is integrally formed with the remainder of the rigid aperture plate.

23. The method as recited in claim 14 wherein a second screen element is positioned adjacent the rigid aperture plate to filter migrating solid particles from entering the inlet.

24. The method as recited in claim 14 wherein the rigid aperture plate is made of steel.

25. The method as recited in claim 16 wherein the linkage assembly comprises:

first and second connectors coupled to the setting mandrel and axially shiftable therewith, first and second probe connection rails to which the probe is coupled, third and fourth connectors, an upper rotating arm extending between the first and second connectors and the first and second probe connection rails to form an articulating connection between the first and/or second connectors and the first and/or second probe connection rails, and a lower rotating arm extending between the third and fourth connectors and the first and second probe connection rails to form an articulating connection between the third and/or fourth connectors and the first and/or second probe connection rails.

* * * * *